US012742267B2

(12) United States Patent
Hanks et al.

(10) Patent No.: US 12,742,267 B2
(45) **Date of Patent: *Sep. 22, 2026**

(54) FABRIC AND ARTICLES HAVING FIRE-RESISTANCE, CUT-RESISTANCE, AND ELASTIC RECOVERY AND PROCESSES FOR MAKING SAME

(71) Applicant: DUPONT SAFETY & CONSTRUCTION, INC., Wilmington, DE (US)

(72) Inventors: Jeffrey Alan Hanks, Midlothian, VA (US); Eric Key, Richmond, VA (US); Olivier Beat Noth, Romont (CH)

(73) Assignee: DUPONT SAFETY & CONSTRUCTION, INC., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/679,856

(22) Filed: Feb. 24, 2022

(65) Prior Publication Data

US 2022/0325443 A1 Oct. 13, 2022

Related U.S. Application Data

(60) Provisional application No. 63/173,705, filed on Apr. 12, 2021.

(51) Int. Cl.

| | |
|---|---|
| ***D02G 3/44*** | (2006.01) |
| ***A41D 31/08*** | (2019.01) |
| ***A41D 31/24*** | (2019.01) |
| ***D02G 3/04*** | (2006.01) |
| ***D02G 3/32*** | (2006.01) |
| ***D03D 15/513*** | (2021.01) |
| ***D03D 15/56*** | (2021.01) |

(52) U.S. Cl.

CPC ..... *D02G 3/443* (2013.01); *A41D 31/08* (2019.02); *A41D 31/24* (2019.02); *D02G 3/047* (2013.01); *D02G 3/32* (2013.01); *D02G 3/442* (2013.01); *D03D 15/513* (2021.01); *D03D 15/56* (2021.01); *D10B 2401/04* (2013.01); *D10B 2401/063* (2013.01); *D10B 2501/041* (2013.01)

(58) Field of Classification Search

CPC ..... D02G 3/443; D02G 3/047; D02G 3/32; D02G 3/442; D02G 3/28–288; A41D 31/08; A41D 31/24; D03D 15/513; D03D 15/56; D10B 2401/04; D10B 2401/063; D10B 2501/041; D10B 2101/20; D10B 2321/101; D10B 2331/021; D04B 1/28

See application file for complete search history.

(56) References Cited

U.S. PATENT DOCUMENTS

| | | | | |
|---|---|---|---|---|
| 2,929,801 | A | 3/1960 | Koller | |
| 2,929,802 | A | 3/1960 | Katz | |
| 2,929,803 | A | 3/1960 | August et al. | |
| 2,929,804 | A | 3/1960 | Steuber | |
| 2,953,839 | A | 9/1960 | Kohrn et al. | |
| 2,957,852 | A | 10/1960 | Frankenburg et al. | |
| 2,962,470 | A | 11/1960 | Shee | |
| 2,999,839 | A | 9/1961 | Arbidson et al. | |
| 3,009,901 | A | 11/1961 | Frazer | |
| 3,748,302 | A | 7/1973 | Jones | |
| 4,107,909 | A | 8/1978 | Fehrer et al. | |
| 4,120,914 | A * | 10/1978 | Behnke | C08L 77/10 524/115 |
| 4,162,275 | A * | 7/1979 | Moulds | D01F 1/07 525/428 |
| 4,249,368 | A | 2/1981 | Fehrer | |
| 4,327,545 | A | 5/1982 | Fehrer | |
| 5,069,957 | A | 12/1991 | Vandermeersch | |
| 5,208,105 | A | 5/1993 | Ichibori et al. | |
| 5,448,779 | A | 9/1995 | Aldridge | |
| 5,506,042 | A | 4/1996 | Ichibori et al. | |
| 5,527,597 | A | 6/1996 | Stanhope et al. | |
| 5,694,981 | A | 12/1997 | Stanhope et al. | |
| 6,952,915 | B2 | 10/2005 | Prickett | |
| 7,065,950 | B2 | 6/2006 | Zhu et al. | |
| 7,348,059 | B2 | 3/2008 | Zhu et al. | |
| 2003/0203688 | A1 * | 10/2003 | Campbell | D02G 3/443 442/167 |

(Continued)

OTHER PUBLICATIONS

PCT International Search Report for Application No. PCT/US2022/018314; Jan Hausding, Authorized Officer; ISA/EPO; May 24, 2022.

(Continued)

*Primary Examiner* — Braelyn R Watson
(74) *Attorney, Agent, or Firm* — Ram W. Sabnis

(57) ABSTRACT

A ply-twisted yarn, and fabric and article comprising the yarn, the yarn comprising:

(a) at least one first yarn comprising at least 50 weight percent heat-resistant polymeric fiber, wherein at least 30 weight percent of the polymeric fiber present in said yarn is cut-resistant heat-resistant polymeric fiber having a cut resistance of 500 grams force or higher per ASTM F2992-15; and (b) at least one second yarn having a sheath/core construction with a sheath of halogenated self-extinguishing staple fibers and a core comprising at least one continuous elastomeric filament, wherein 60 to 95 weight percent of (b) is halogenated self-extinguishing fiber, and the halogenated self-extinguishing fiber being in contact with the elastomeric filament and being free or substantially free of inorganic fibers.

13 Claims, No Drawings

(56) References Cited

U.S. PATENT DOCUMENTS

| | | | | |
|---|---|---|---|---|
| 2005/0091961 | A1* | 5/2005 | Prickett | D04B 1/28 57/238 |
| 2006/0105658 | A1* | 5/2006 | Patz | D03D 15/513 442/181 |
| 2006/0160454 | A1* | 7/2006 | Handermann | B32B 5/08 442/403 |
| 2009/0183296 | A1 | 7/2009 | Hardee et al. | |
| 2013/0055490 | A1* | 3/2013 | Zhu | D03D 15/527 2/458 |
| 2015/0322598 | A1 | 11/2015 | Stanhope et al. | |
| 2020/0367584 | A1* | 11/2020 | Truesdale, III | D06M 15/564 |

OTHER PUBLICATIONS

PCT International Search Report for Application No. PCT/US2022/018309; Jan Hausding, Authorized Officer; ISA/EPO; May 24, 2022.

* cited by examiner

FABRIC AND ARTICLES HAVING FIRE-RESISTANCE, CUT-RESISTANCE, AND ELASTIC RECOVERY AND PROCESSES FOR MAKING SAME

BACKGROUND OF THE INVENTION

1. Field of the Invention. This invention relates to yarns and fabrics suitable for use in articles of protective clothing that have fire-resistant and form-fitting properties and also have cut resistant properties.

Description of Related Art. Ply-twisted yarns and fabric having cut-resistance and elastic recovery, processes for making same, and their used in articles of protective clothing is disclosed in U.S. Pat. No. 6,952,915.

Yarns comprising modacrylic fiber, p-aramid fiber, and m-aramid fiber that are useful for the production of fabrics which possess arc and flame protective properties are disclosed, for example, in U.S. Pat. Nos. 7,065,950 and 7,348,059. These yarns may further comprise, as an optional component, 2 to 15 weight percent of an abrasion-resistant fiber such as a nylon and/or 1 to 5 weight percent of an antistatic component.

Yarns and fabrics having a combination of fire resistance and elastic recovery properties are described, for example, in U.S. Pat. Nos. 5,069,957; 5,527,597; and 5,694,981. These existing solutions utilize yarns made by covering elastic core yarns with a substantial protective fiber outer covering made from a fire-resistant fiber. In other words, these references describe protecting the elastic core by structurally shielding the elastic core from flame by use of another fiber that is in the same yarn.

As used herein, the terms "structural shielding" and "structural shield" mean the cover fibers simply char and remain in place in a yarn covering any elastic filaments in the core when exposed to a flame and therefore provide a structural barrier between a flame and the elastic core. As taught in these patents, these yarns are provided with a substantial protective fiber outer covering made from a fire-resistant fiber that physically protects the elastic core yarns from degradation or melting, when exposed to extreme temperatures and fire.

Unfortunately, in many instances, the fibers that provide an adequate structural shielding outer fiber covering also tend to be stiffer fibers, and therefore fabrics made with such yarns can be less comfortable than desired. This ultimately translates to protective apparel that can be less comfortable than desired, and it is well known that workers tend to not wear their protective gear if it is not adequately comfortable, putting themselves at risk.

Additionally, any solution for protecting the elastic core should meet current protective apparel standards. Specifically, the recent NFPA 2112-2018 "Standard on Flame-Resistant Clothing for Protection of Industrial Personnel Against Short-Duration Thermal Exposures from Fire" provides specifications for the minimum design, performance, testing, and certification requirements and test methods for flame-resistant garments, shrouds, hoods, balaclavas, and gloves for use in areas at risk from short-duration thermal exposure from fire. The Standard requires the fabric used in the garments have an afterflame time of not more than 2 seconds. The afterflame time is the time, in seconds, to the nearest 0.2 second, that the specimen continues to flame after the burner is removed from the flame.

The Standard has even more stringent requirements for flame-resistant gloves, in that the material consumed in the flame resistance testing should not exceed 5.0 percent of the specimen's original weight. In other words, after the specified 12 seconds of flame is applied to a specimen per the procedure in the Standard, the fabric weight loss should be 5.0 percent or less.

Therefore, what is needed is a yarn and/or fabric having a combination of fire resistance and elastic recovery properties, along with cut resistance, that specifically incorporates elastic core yarns, that meets the NFPA 2112-2018 Standard; and that further utilizes fibers that have a textile feel to potentially provide a more comfortable protective apparel article.

BRIEF SUMMARY OF THE INVENTION

This invention relates to a ply-twisted yarn suitable for used in a flame-retardant, cut-resistant fabric, and fabrics and articles containing same, the ply-twisted yarn comprising:

(a) at least one first yarn comprising at least 50 weight percent heat-resistant polymeric fiber, wherein at least 30 weight percent of the polymeric fiber present in the at least one first yarn is cut-resistant heat-resistant polymeric fiber having a cut resistance of 500 grams force or higher per ASTM F2992-15; and (b) at least one second yarn having a sheath/core construction with a sheath of halogenated self-extinguishing staple fibers and a core comprising at least one continuous elastomeric filament, wherein 60 to 95 weight percent of the at least one second yarn is halogenated self-extinguishing fiber, and the halogenated self-extinguishing fiber is in contact with the at least one continuous elastomeric filament, the second yarn being free or substantially free of inorganic fibers.

DETAILED DESCRIPTION OF THE INVENTION

This invention relates to yarns and fabrics, suitable for use in articles of protective clothing, that have both fire-resistant and form-fitting properties, and additionally provide cut protection. The unique combination is created by combining elastic materials, self-extinguishing fibers, and strong heat-resistant polymeric fibers in a manner to provide high fire resistance in a yarn or fabric along with limited consumption of the fabric during burning.

Specifically, this invention relates to a ply-twisted yarn suitable for used in a flame-retardant, cut-resistant fabric, the ply-twisted yarn comprising:

(a) at least one first yarn comprising at least 50 weight percent heat-resistant polymeric fiber, wherein at least 30 weight percent of the polymeric fiber present in the at least one first yarn is cut-resistant heat-resistant polymeric fiber having a cut resistance of 500 grams force or higher per ASTM F2992-15; and (b) at least one second yarn having a sheath/core construction with a sheath of halogenated self-extinguishing staple fibers and a core comprising at least one continuous elastomeric filament, wherein 60 to 95 weight percent of the at least one second yarn is halogenated self-extinguishing fiber, and the halogenated self-extinguishing fiber is in contact with the at least one continuous elastomeric filament, the second yarn being free or substantially free of inorganic fibers.

This yarn can provide fabrics that have a maximum after-flame time of two seconds or less and weight loss of 5 weight percent of less when tested per NFPA-2112-2018.

By "flame-resistant cut-resistant fabric", it is meant a knitted or woven fabric that is both "flame resistant" and "cut resistant". By the descriptor "flame resistant", in regard to a fabric, it is meant the fabric has a char length equal to or less than 4 inches (100 mm) when tested per ASTM 6143-15. By "cut resistant fabric", it is meant the fabric has at least a minimum level of cut resistance, and generally a cut-resistant fabric has a cut resistance of at least 200 grams force per ASTM F2992-15. In some preferred embodiments, the fiber and yarns described herein can provide a flame-resistant cut-resistant fabric having a cut resistance of at least 500 grams force per ASTM F2992-15. However, it is understood that in some other embodiments, other fibers or yarns that don't necessarily provide cut resistance but may provide other desirable qualities to the fabric may be incorporated into the fabric as long as the flame performance requirements describe herein to be considered a "flame-resistant" fabric are met and the fabric retains a minimum cut-resistance of at least 200 grams force per ASTM F2992-15.

Flame-resistant fabrics provide thermal protection from thermal events, while cut resistant fabrics provide mechanical protection from such things as knives and sharp edges. In addition, it is often important or desirable for any articles, such as protective gloves, that are made from such fabrics be comfortable and have good fit and dexterity. By "good fit and dexterity" it is meant, for example, that gloves conform nicely to the shape of the hands of the wearer and one is able to pick up and manipulate small objects while wearing the gloves. The flame-resistant cut-resistant fabrics that can be provided by the yarns as described herein are both highly flame-resistant and cut-resistant, while also providing articles that are soft, flexible, and form fitting. Protective apparel made from such fabrics is very comfortable and effective against multiple threats.

The flame-resistant cut-resistant fabric is made from at least a first yarn that provides a heat-resistant polymeric fiber and at least a second yarn that provides at least one continuous elastomeric filament covered by halogenated self-extinguishing fiber that is in contact with the at least one continuous elastomeric filament. The at least first yarn and the at least second yarn are then used to make the fabric.

The at least first yarn and the at least second yarn are twisted together to form a ply-twisted yarn. In some embodiments, the ply-twisted yarn consists of only one first yarn and only one second yarn. In other embodiments, the ply-twisted yarn consists of only one first yarn and a plurality of second yarns; and in other embodiments, the ply-twisted yarn consists of a plurality of first yarns and only one second yarn. Likewise, in some embodiments the ply-twisted yarn consists of a plurality of first yarns and a plurality of second yarns. Finally, in some embodiments, the ply-twisted yarn comprises at least one first yarn and at least one second yarn; other yarns made from any number of fibers can be included in ply-twisted yarn as long the final fabric meets the performance criteria discussed herein.

The at least one first yarn comprises at least 50 weight percent heat-resistant polymeric fiber, based on the total weight of the first yarn, and wherein at least 30 weight percent of the polymeric fiber present in the at least one first yarn is cut-resistant heat-resistant polymeric fiber having a cut resistance of 500 grams force or higher per F2992-15, the at least one first yarn further having a sheath/core construction with the sheath comprising the cut-resistant heat-resistant polymeric fiber and the core comprising an inorganic fiber. The sheath/core construction is used because the sheath staple fibers provide a cover and shield the inorganic filament in the core from direct abrasive contact with the skin giving the fabrics containing the sheath/core yarn improved comfort.

By "heat resistant polymeric fiber", it is meant a fiber made from a synthetic organic polymer that retains 90 percent of its original fiber weight when heated in air to 500° C. at a rate of 20° C. per minute. Preferred heat resistant polymeric fibers have a yarn tenacity of at least 3 grams per denier (2.7 grams per dtex). Heat resistant polymeric fibers include para-aramid fibers, aramid copolymer fibers, polybenzazole fibers, polybenzimidazole fibers, polyimide fibers, and mixtures thereof. Preferred heat resistant polymeric fibers are para-aramid fibers, and the preferred para-aramid fiber is poly(paraphenylene terephthalamide fiber.

The at least one first yarn comprises at least 50 weight percent heat-resistant polymeric fiber based on the total weight of the first yarn. In some embodiments, the at least one first yarn comprises at least 60 weight percent heat-resistant polymeric fiber based on the total weight of the first yarn. In some embodiments, the at least one first yarn comprises 60 to 85 weight percent heat-resistant polymeric fiber based on the total weight of the first yarn, and in some other embodiments, the at least one first yarn comprises 60 to 80 weight percent heat-resistant polymeric fiber, based on the total weight of the first yarn.

At least 30 weight percent of the polymeric fiber present in the at least one first yarn is cut-resistant heat-resistant polymeric fiber having a cut resistance of 500 grams force or higher per F2992-15. The cut performance of a fiber is determined by measuring the cut performance of a 345 grams/square meter (10 ounces/square yard) fabric that is woven or knitted from 100% of the fiber to be tested, and then the cut resistance (in grams-force) is measured by ASTM F2992-15.

Cut-resistant heat-resistant polymeric fibers having a cut resistance of 500 grams-force or higher per F2992-15 include para-aramid fibers, aramid copolymer fibers, polybenzazole fibers, polybenzimidazole fibers and mixtures thereof. Preferred cut-resistant heat-resistant polymeric fibers are para-aramid fibers, and the preferred para-aramid fiber is poly(paraphenylene terephthalamide fiber. The cut-resistant heat-resistant polymeric fiber in the at least one first yarn can be the same or different from the heat-resistant polymeric fiber in the at least one first yarn, if the heat-resistant polymeric fiber has adequate cut-resistance.

Therefore, it is understood that cut-resistant heat-resistant polymeric fiber is both a heat-resistant polymeric fiber as previously defined and a cut-resistant fiber as previously defined. It is also understood that the at least one first yarn can include fiber that is heat-resistant polymeric fiber as defined herein but is not cut-resistant fiber as defined herein. Table 1 provides a guide, giving selected example compositions, as to the possible percentages of total heat-resistant (CH-HR) polymeric fiber and total inorganic filament in the at least one first yarn, and further provides possible percentages illustrating possible amounts of non-cut-resistant heat-resistant (Non-CR HR) polymeric fiber and cut-resistant heat-resistant (CH-HR) polymeric fiber.

TABLE 1

| Total HR Fiber (all types) in First Yarn (wt %) | Minimum Amount of Non-CR HR Fiber (wt %) | Maximum Amount of CR-HR Fiber (wt %) | Maximum Amount of Non-CR HR Fiber (wt %) | Minimum Amount of CR-HR Fiber (wt %) | Total Inorganic Filament in First Yarn (wt %) |
|---|---|---|---|---|---|
| 50 | 0 | 50 | 20 | 30 | 50 |
| 60 | 0 | 60 | 30 | 30 | 40 |
| 70 | 0 | 70 | 40 | 30 | 30 |
| 80 | 0 | 80 | 50 | 30 | 20 |
| 85 | 0 | 85 | 55 | 30 | 15 |

Therefore, it is understood that the at least 30 weight percent of the polymeric fiber present in the at least one first yarn is both a cut-resistant and heat-resistant polymeric fiber as defined herein. In some embodiments, 50 to 85 weight percent of the at least one first yarn is cut-resistant and heat-resistant polymeric fiber.

In addition to the various example percentages of cut-resistant heat-resistant polymeric fiber and non-cut-resistant heat-resistant polymeric fiber shown in Table 1, in some embodiments, the at least one first yarn further comprises other synthetic or organic fibers or filaments that are not heat-resistant polymeric fiber; that is, they do not meet the definition of a heat-resistant polymeric fiber provided herein. Essentially any type of fiber can be included as long as long the final fabric meets the compositions described herein and the performance criteria discussed herein. Preferably, the fibers or filaments that are not heat-resistant polymeric fiber are organic fibers and in some embodiments are polymeric organic fibers. Also, in some embodiments, if present, the fibers or filaments that are not heat-resistant polymeric fiber are organic or synthetic staple fibers.

In some preferred embodiments, in addition to heat-resistant fiber and cut-resistant heat-resistant fiber, the at least one first yarn can further comprise flame-resistant fiber. By "flame-resistant fiber", it is meant that a fabric made solely from that fabric has a char length equal to or less than 4 inches and an afterflame equal to or less than 2 seconds per the vertical flame test of ASTM D6143-99; but the fiber does not meet the cut-resistance criteria previously described herein for cut-resistant heat-resistant polymeric fibers. Suitable flame-resistant fibers include meta-aramid fibers, with the preferred meta-aramid being poly(metaphenylene isophthalamide). Potentially useful flame-resistant fiber include meta-aramid, polyamide-imide, flame-retardant-treated (FR) cellulose, FR cotton, FR lyocell, or mixtures thereof. In some embodiments, the at least one first yarn has preferably 10 weight percent to as much as 35 weight percent flame-resistant fiber, based on the total weight of the polymeric fiber in the first yarn.

Both the heat-resistant polymeric fiber and the cut-resistant heat-resistant polymeric fiber in the at least one first yarn are staple fibers preferably having a length of about 2 to 20 centimeters, preferably about 3.5 to 6 centimeters. Both the heat-resistant polymeric fiber and the cut-resistant heat-resistant polymeric fiber in the at least one first yarn are staple fibers preferably having a diameter of 5 to 25 micrometers and a linear density of 0.5 to 7 dtex. Also, in some embodiments, if present, the fibers or filaments that are flame resistant fibers or are not heat-resistant polymeric fiber are staple fibers having dimensions similar to the above ranges for the heat-resistant polymeric fiber and the cut-resistant heat-resistant polymeric fiber.

In some embodiments, the inorganic fiber is present in an amount of 15 to 40 weight percent of the total weight of the first yarn. Likewise, the maximum amount of the heat-resistant polymeric fiber in these sheath-core first yarns is 85 weight percent, based on the total weight of the first yarn. In some preferred embodiments, the sheath/core yarns have 60 to 80 weight percent heat-resistant polymeric fiber in the sheath and 20-40 weight percent inorganic fiber in the core. Preferably the inorganic fiber in the core is a steel or tungsten. Preferably, the inorganic fiber in the core is present as one or more continuous filaments.

The sheath fiber can be wrapped or spun around the inorganic filament core. Specifically, this can be achieved by known means, such as, conventional ring spinning including improvements to the conventional process such as those utilizing COTSON technology; core-spun spinning such as DREF spinning; air-jet spinning using so-called core insertion with Murata (now Muratec) jet-like spinning; open-end spinning, and the like. Preferably the staple fiber is consolidated around the inorganic filament core at a density sufficient to cover the core. The degree of coverage depends on the process used to spin the yarn; for example, core-spun spinning such as DREF spinning (disclosed, for example, in U.S. Pat. Nos. 4,107,909; 4,249,368; & 4,327,545) provides better coverage than ring spinning. Conventional ring spinning provides only partial coverage of the center core, but even partial coverage can provide adequate sheath/core coverage. The sheath can also include some fibers of other materials to the extent that decreased cut resistance, due to that other material, can be tolerated.

The incorporation of the at least one inorganic filament as the core in the first yarn can be achieved, for example in its simplest practical application, by passing a roving, sliver, or collection of the heat-resistant and cut resistant fibers, and optionally the non-heat resistant fibers through sets of drafting rolls to make a drafted fiber mass to be ring twisted into a single yarn. The at least one inorganic filament is typically fed from a bobbin through a set of feed rolls and subsequently into the staple fibers prior to the final set of drafting rollers. Since the inorganic core filament(s) are not elastomeric they do not have to be over-tensioned during insertion into the yarn, with only enough tension applied to either the sheath fibers and the core as is conventionally used.

The at least one first yarn in the form of a sheath/core yarn generally comprises 15-50 weight percent inorganic filament(s) with a total linear sheath/core yarn density of 100 to 5000 dtex. The core comprising an inorganic fiber can be a single filament, or may be multifilament, and is preferably a single metal filament or several metal filaments, as needed or desired for a particular application or degree of cut protection. By metal filament is meant filament or wire made from a ductile metal such as stainless steel, copper, aluminum, bronze, tungsten and the like, or metal fiber constructions commonly known as "micro-steel". Stainless steel is the preferred metal. The metal filaments are generally continuous wires. Useful metal filaments are 1 to 150 micrometers in diameter and are preferably 25 to 75 micrometers in diameter.

In some embodiments, the inorganic fiber is a glass filament. It can be one or more glass filaments, such as for example 110 dtex (100 denier) glass filament. However, glass is less preferred because it has less cut resistance per linear density than metal and it is much more critical that the glass be substantially covered by the staple fiber sheath to minimize skin irritation should the yarn be used in gloves, sleeves, etc., where the fabric is in contact with the skin. Therefore, in many embodiments the inorganic fiber is not a glass filament but a metal filament.

The at least one second yarn has a sheath/core construction with a sheath of halogenated self-extinguishing staple fibers and a core comprising at least one continuous elastomeric filament, wherein 60 to 95 weight percent of the at least one second yarn is halogenated self-extinguishing fiber, based on the total weight of the second yarn, and the halogenated self-extinguishing fiber is in contact with the at least one continuous elastomeric filament, the second yarn being free or substantially free of inorganic fibers.

The at least one second yarn has a sheath/core construction, with the sheath of halogenated self-extinguishing staple fibers being in contact with and covering the core of the at least one continuous elastomeric filament. It is believed that the halogenated self-extinguishing staple fibers provide an active flame-extinguishing cover for the core of the at least one continuous elastomeric filament. This is unlike cover fibers that provide "structural shielding" of the core, that is, cover fibers that simply char and remain in place when exposed to a flame and therefore provide a structural barrier between a flame and the elastic core. Instead, the sheath of halogenated self-extinguishing staple fibers decomposes in the presence of high thermal flux as in a flame, releasing a halogen gas that displaces localized oxygen from the yarn and hinders the burning of the core of the at least one continuous elastomeric filament. Therefore, it is believed that halogenated self-extinguishing staple fibers should not only cover the core but be in direct contact with the core to locally displace oxygen from the surface of the core of the at least one continuous elastomeric filament.

The sheath of halogenated self-extinguishing staple fibers can be wrapped or spun around the at least one continuous elastomeric filament. This can be achieved by known means, such as, conventional ring spinning including improvements to the conventional process such as those utilizing COTSON technology; core-spun spinning such as DREF spinning; air-jet spinning using so-called core insertion with Murata (now Muratec) jet-like spinning; open-end spinning, and the like. Preferably the staple fiber is consolidated around the core of at least one continuous elastomeric filament at a density sufficient to cover the core. The degree of coverage depends on the process used to spin the yarn; for example, core-spun spinning such as DREF spinning (disclosed, for example, in U.S. Pat. Nos. 4,107,909; 4,249,368; & 4,327,545) provides better coverage than ring spinning. Conventional ring spinning provides only partial coverage of the center core, but even partial coverage is assumed a possible sheath/core structure herein.

It is believed the flame-extinguishing effect of the halogenated self-extinguishing staple fibers is adequate when 60 to 95 weight percent of the at least one second yarn is halogenated self-extinguishing fiber, based on the total weight of the second yarn. In some embodiments, it is desirable for 80 to 95 weight percent of the at least one second yarn to be the halogenated self-extinguishing fiber, based on the total weight of the second yarn. The sheath can also include some fibers of other materials to the extent that decreased flame-extinguishing effect, due to that other material, can be tolerated.

Halogenated self-extinguishing fibers include those made from halogenated polymer. One especially preferred halogenated self-extinguishing fiber is a fiber made from a modacrylic polymer. By "modacrylic polymer" it is meant preferably the polymer is a copolymer comprising 30 to 70 weight percent of acrylonitrile and 70 to 30 weight percent of a halogen-containing vinyl monomer. The halogen-containing vinyl monomer is at least one monomer selected, for example, from vinyl chloride, vinylidene chloride, vinyl bromide, vinylidene bromide, etc.

In some embodiments the modacrylic copolymers are those of acrylonitrile combined with vinylidene chloride. In some embodiments, the modacrylic copolymer has in addition antimony oxide or antimony oxides. In some preferred embodiments the modacrylic copolymer has either less than 1.5 weight percent antimony oxide or antimony oxides, or the copolymer is totally free of antimony. Very low antimony content polymer and antimony-free polymer can be made by restricting the amount of, or eliminating entirely, any antimony compounds added to the copolymer during manufacture. Representative processes for modacrylic polymers, including those that can be modified in this manner are disclosed in U.S. Pat. No. 3,193,602 having 2 weight percent antimony trioxide; U.S. Pat. No. 3,748,302 made with various antimony oxides that are present in an amount of at least 2 weight percent and preferably not greater than 8 weight percent; and U.S. Pat. Nos. 5,208,105 & 5,506,042 having 8 to 40 weight percent of an antimony compound. In some embodiments, the modacrylic polymer has an LOI of at least 26. In one preferred embodiment the modacrylic polymer has a LOI of at least 26 while also being antimony-free.

The halogenated self-extinguishing staple fibers in the at least one second yarn are staple fibers preferably having a length of about 2 to 9 centimeters, preferably about 3.5 to 6 centimeters. The halogenated self-extinguishing staple fibers in the at least one second yarn are staple fibers preferably having a diameter of 5 to 25 micrometers and a linear density of 0.5 to 7 dtex.

The ply-twisted yarn contains at least one second yarn having a sheath/core construction with a sheath of halogenated self-extinguishing staple fibers and a core comprising at least one continuous elastomeric filament. The halogenated self-extinguishing fiber is in contact with the at least one continuous elastomeric filament, eliminating the need for the entire surface of the elastomeric filament(s) to actually be fully covered by the staple fiber sheath.

In some embodiments, preferably at least 90% of the core is covered by the sheath, as viewed under a microscope with the yarn in a relaxed condition; that is, wherein the sheath-core yarn is viewed when not under tension. The actual covering of the core can depend on the degree the yarn is tensioned; however, it is believed the modacrylic provides its shielding benefit as long as it is in contact with the elastomeric core.

In some embodiments, 5 to 40 weight percent of the total weight of the at least one second yarn is the at least one continuous elastomeric filament. In some embodiments, a ring-spun second yarn has a core comprising at least one elastomeric filament and a partially covering of halogenated self-extinguishing staple fibers. In some preferred embodiments, the core of elastomeric filament(s) comprises 5 to 25 weight percent of the total sheath/core single yarn linear density of 100 to 1500 dtex.

A "core comprising at least one continuous elastomeric filament", as used herein, means a core formed from or containing filaments of an elastomer, the core preferably having the ability to return to its original length rapidly after repeated stretching, even to at least twice its original length. Preferred elastomeric cores include polyurethane based yarns such as spandex or elastane; however, any fiber generally having stretch and recovery can be used. Suitable well-known elastomeric yarns also include the products sold under the tradenames Dorlastan® and Lycra®.

The preferred at least one continuous elastomeric filament is spandex fiber. As used herein, "spandex" has its usual definition, that is, a manufactured fiber in which the fiber-forming substance is a long chain synthetic polymer composed of at least 85% by weight of a segmented polyurethane. Among the segmented polyurethanes of the spandex type are those described in, for example, U.S. Pat. Nos. 2,929,801; 2,929,802; 2,929,803; 2,929,804; 2,953,839; 2,957,852; 2,962,470; 2,999,839; and 3,009,901.

In some processes for making spandex elastomeric filaments, coalescing jets are used to consolidate the spandex filaments immediately after extrusion. It is also well known that dry-spun spandex filaments are tacky immediately after extrusion. The combination of bringing a group of such tacky filaments together and using a coalescing jet will produce a coalesced multifilament yarn, which is then typically coated with a silicone or other finish before winding to prevent sticking on the package. Such a coalesced grouping of filaments, which is actually a number of tiny individual filaments adhering to one another along their length, is superior in many respects to a single filament of spandex of the same linear density.

The elastomeric filament in the elastomeric single yarn is preferably a continuous filament and can be present in the second yarn in the form of one or more individual filaments or one or more coalesced grouping of filaments. However, it is preferred to use only one coalesced grouping of filaments in the preferred elastomeric single yarn. Whether present as one or more individual filaments or one or more coalesced groupings of filaments, the overall linear density of the elastomer filament(s) in the relaxed state is generally between 17 and 560 dtex (15 and 500 denier) with the preferred linear density range being 44 to 220 dtex (40 to 200 denier).

It is preferred to incorporate the at least one continuous elastomeric filament in the second yarn under tension by drawing or stretching the at least one continuous elastomeric filament prior to the combination with staple fibers by using a slower delivery speed of the at least one continuous elastomeric filament relative to the final second yarn speed. This drawing can be described as the stretch ratio of the continuous elastomeric filament, which is the final second yarn speed divided by the delivery speed of the continuous elastomeric filament.

Typical stretch ratios are 1.5 to 5.0 with 1.5 to 3.50 being preferred. Low stretch ratios yield less elastic recovery while very high stretch ratios make the single yarns difficult to process and the fabric too tight and uncomfortable. The optimum stretch ratio is also dependent on the % weight content of elastomeric core. Tension devices can also be employed to tension and stretch the elastomeric fiber but are less preferred due to the difficulty in reproducing and controlling tension and stretch. The optimum stretch ratio is ultimately determined for each fabric, based on the desired fit and feel of the fabric.

The incorporation of the at least one continuous elastomeric filament into the second yarn of halogenated self-extinguishing staple fibers can be achieved, for example in its simplest practical application, by passing a roving, sliver, or collection of the halogenated self-extinguishing staple fibers through sets of drafting rolls to make a drafted fiber mass to be ring twisted into a single yarn. The at least one continuous elastomeric filament is typically fed from a bobbin through a set of feed rolls and subsequently into the staple fibers prior to the final set of drafting rollers. The slower relative surface speed of the feed rollers to the surface speed of the drafting rollers is increased or decreased to determine the amount of elastic stretch and tension in the final ring-twisted single yarn using conventional techniques.

In some embodiments, the sheath of the at least one second yarn can further comprise heat-resistant polymeric fiber as previously described herein. In some other embodiments, the sheath of the at least one second yarn can further comprise cut-resistant heat-resistant polymeric fiber as previously described herein.

In some embodiments, the sheath of the at least one second yarn can further comprise flame-resistant fiber. By "flame-resistant" fiber, it is meant that a fabric made solely from that fabric has a char length equal to or less than 4 inches and an afterflame equal to or less than 2 seconds per the vertical flame test of ASTM D6143-99. Suitable flame-resistant fibers include aramid fibers, with meta-aramid fibers being especially preferred; the preferred meta-aramid is poly(metaphenylene isophthalamide). Potentially useful flame-resistant fibers include meta-aramid, polyamide-imide, flame-retardant-treated (FR) cellulose, FR cotton, FR lyocell, or mixtures thereof. Any number of fibers can be included in the second yarn as long the second yarn and the final fabric meets the performance criteria discussed herein.

If used in the second yarn, the heat-resistant polymeric fiber, the cut-resistant heat-resistant polymeric fiber, or the flame-resistant fiber are preferably staple fibers preferably having a length of about 2 to 20 centimeters, preferably about 3.5 to 6 centimeters. Also, if used in the second yarn, the heat-resistant polymeric fiber, the cut-resistant heat-resistant polymeric fiber, and the flame-resistant fiber are preferably staple fibers preferably having a diameter of 5 to 25 micrometers and a linear density of 0.5 to 7 dtex.

In some embodiments, the sheath of the at least one second yarn can further comprise what are known in the art as antistatic fibers or fibers that have the ability to reduce the accumulation of electrical charge in the yarn or in the resultant fabric. In some preferred embodiments the sheath of the at least one second yarn includes at least 1-5 weight percent antistatic fiber, based on the total weight the at least one second yarn. Preferred antistatic fibers are those that function by the present of carbon in the fiber, either as a carbon coating or carbon particles; especially antistatic fibers that help to eliminate the buildup of charge but are not considered to be electrically conductive in a practical sense. In some embodiments, aramid fiber that contain carbon particles is preferred.

The second yarn is free or substantially free of inorganic fibers. The cut-resistant benefits of the ply-twisted yarn is supplied by the first yarn, eliminating the need for additional inorganic fiber in the second yarn for majority of the intended applications.

The ply-twisted yarn is formed from the at least first yarn and the at least second yarn. Ply-twisted yarns are made by twisting together at least two individual single yarns. By the phrase "twisting together at least two individual single yarns", it is meant the two single yarns are twisted together without one yarn fully covering the other. This distinguishes ply-twisted yarns from covered or wrapped yarns where a first single yarn is substantially or completely wrapped around a second single yarn so that ideally only the first single yarn is exposed on the surface of the resulting covered yarn.

In one preferred embodiment, the ply-twisted yarn is made from at least two singles yarns, the first singles yarns being (a) the at least one first yarn comprising at least 50 weight percent heat-resistant polymeric fiber, based on the total weight of the first yarn, and wherein at least 30 weight percent of the polymeric fiber present in the at least one first yarn is cut-resistant heat-resistant polymeric fiber having a cut resistance of 500 grams force or higher per F2992-15, the at least one first yarn further having a sheath/core construction with the sheath comprising the cut-resistant heat-resistant polymeric fiber and the core comprising an inorganic fiber; and the second singles yarn being (b) the at least one second yarn having a sheath/core construction with a sheath of halogenated self-extinguishing staple fibers and a core comprising at least one continuous elastomeric filament, wherein 60 to 95 weight percent of the at least one second yarn is halogenated self-extinguishing fiber, based on the total weight of the second yarn, and the halogenated self-extinguishing fiber is in contact with the at least one continuous elastomeric filament, the second yarn being free or substantially free of inorganic fibers. Each of the single yarns may have some twist.

In some embodiments, the ply-twisted yarns made from the two singles yarns have a total linear density of from 200 to 3000 dtex. The individual staple fibers in either of the singles yarn can have a linear density of 0.5 to 7 dtex, with the preferred linear density range being 1.5 to 3 dtex. The ply-twisted yarns, and the single yarns that make up those ply-twisted yarns, can include other materials as long as the function or performance of the yarn or fabric made from that yarn is not compromised for the desired use.

The ply-twisted yarns can be made from single yarns via the processes disclosed in U.S. Pat. No. 6,952,915 to Prickett, and the ply-twisted yarns can have a wide range of ply twist as disclosed therein. For example, either a two-step or combined process can be used. In the first step of the two-step process, two or more single yarns are combined parallel to one another with no ply twist and wound onto a package. In the next step, the two or more combined single yarns are then ring twisted together, using the reverse twist of the single yarns (if they have twist) to form a ply-twisted yarn. Ply-twisted yarns normally have "Z" twist and single yarns normally have "S" twist. Alternatively, a combined process can be employed to ply twist the singled yarns, which combines both of these steps in one operation. Equipment commonly used to ply twist single yarns is sold by equipment manufacturers such as Volkmann and Muratec (formerly Murata).

The ply-twisted yarns may then be combined with other same or different ply-twisted yarns to form a yarn bundle to form a fabric, or the individual ply-twisted yarns can be used to form the fabric, depending on the desired fabric requirements. For example, two or more of the described ply-twisted yarns can be combined to form a yarn bundle that can be fed to a knitting machine with or without twist. Alternatively, a yarn bundle could be made with one or more of the described ply-twisted yarns with one or more different single yarn to impart desired properties to the final fabric. Since modern knitting machines can knit fabric from a feed of multiple ply-twisted yarns, the bundle of ply-twisted yarns fed to the machine need not have twist, although twist can be put into the bundle if desired.

The at least first yarn used in the preferred ply-twisted yarn preferably has a poly(paraphenylene terephthalamide) (PPD-T) staple sheath, the PPD-T having a 3.8 cm (1.5 inch) cut length and a filament density of 1.7 dtex per filament (1.5 denier per filament). The staple sheath can be in the form of a 14 to 29 cotton count yarn.

The at least one second yarn used in the preferred ply-twisted yarn is a single 330 dtex (295 denier, equivalent to 18 cotton count) yarn that is ring-spun. The yarn has a modacrylic staple sheath that at least partially covers the elastomeric core filaments, the modacrylic staple having a 4.8 cm (1.89 inch) cut length and a filament density of 1.7 dtex per filament (1.5 denier per filament). The elastomeric core is a 78 dtex (70 denier) spandex coalesced filament yarn having a 3.0× stretch ratio (approximately 200 percent elongation). In some preferred embodiments, approximately 92 weight percent of the second yarn is comprised of the modacrylic staple and with 8 weight percent of the second yarn being the elastomeric core.

The invention also relates to a cut-resistant woven or knitted fabric made from ply-twisted yarns or a bundle of yarns that includes a ply-twisted yarn, wherein the ply-twisted yarn comprises at least one first yarn and one second yarn as described herein.

Specifically, the invention relates to a cut-resistant woven or knitted fabric made from a ply-twisted yarn made from at least two singles yarns, the first singles yarn being (a) the at least one first yarn comprising at least 50 weight percent heat-resistant polymeric fiber, based on the total weight of the first yarn, and wherein at least 30 weight percent of the polymeric fiber present in the at least one first yarn is cut-resistant heat-resistant polymeric fiber having a cut resistance of 500 grams force or higher per F2992-15, the at least one first yarn further having a sheath/core construction with the sheath comprising the cut-resistant heat-resistant polymeric fiber and the core comprising an inorganic fiber; and the second singles yarn being (b) the at least one second yarn having a sheath/core construction with a sheath of halogenated self-extinguishing staple fibers and a core comprising at least one continuous elastomeric filament, wherein 60 to 95 weight percent of the at least one second yarn is halogenated self-extinguishing fiber, based on the total weight of the second yarn, and the halogenated self-extinguishing fiber is in contact with the at least one continuous elastomeric filament, the second yarn being free or substantially free of inorganic fibers. Preferably, the cut-resistant woven or knitted fabric have a maximum after-flame time of two seconds or less and weight loss of 5 weight percent of less when tested per NFPA-2112-2018.

The at least one first yarn and the at least one second yarn work synergistically together in the ply-twisted yarn; the at least one continuous elastomeric filament incorporated into the yarn(s) provides improved stretch and recovery, while the heat-resistant staple fibers provide structure in flame and the heat-resistant cut-resistant organic staple fibers and inorganic filaments provide the fabric with excellent cut resistance. Fabrics made from such yarn(s) are soft, comfortable and non-abrasive as well as cut resistant.

Ply-twisting of the first yarn with the second yarn helps hold the elastomer single yarn in an extended state without looping upon itself when relaxed. Further, when the bundle is comprised of ply-twisted yarns tension control of the yarns while knitting and weaving is less critical.

Woven and/or knit fabric can comprise the ply-twisted yarns described herein. Preferred woven and knit fabrics have a maximum after-flame time of two seconds or less and weight loss of 5 weight percent of less when tested per NFPA-2112-2018.

The preferred fabric is a knit fabric, and any appropriate knit pattern is acceptable. Cut resistance and comfort are affected by tightness of the knit and that tightness can be adjusted to meet any specific need. A very effective combination of cut resistance and comfort for many cut resistant articles has been found in, for example, single jersey and terry knit patterns. The fabrics preferably have a basis weight of about 4 to 30 oz/yd$^2$, preferably 6 to 25 oz/yd$^2$, the fabrics at the high end of the basis weight range providing more thermal and cut protection.

Articles can comprise the ply-twisted yarns described herein or articles can be made from the aforementioned fabrics comprising the ply-twisted yarns described herein. Especially useful articles include gloves, sleeves, and aprons.

Test Methods

Afterflame and Weight Loss were determined according to NFPA 2112-2018 "Standard on Flame-Resistant Clothing for Protection of Industrial Personnel Against Short-Duration Thermal Exposures from Fire", specifically the procedure outline in Section 8.8 of that Standard.

The determination of a "heat resistant polymeric fiber" as discussed herein can be achieved by the use of ASTM E2105-2016—Standard Practice for General Techniques of Thermogravimetric Analysis (TGA) Coupled With Infrared Analysis (TGA/IR). The analysis of whether or not a synthetic organic polymer retains 90 percent of its original fiber weight is conducted by heating a sample in air to 500° C. at a rate of 20° C. per minute.

EXAMPLES

Ply-twisted yarns and knits made from the yarns are exemplified in Examples 1, 2, and 3 and Comparative Example A and summarized in Table 5.

Example 1

A ply-twisted elastic yarn was made by ply twisting a first yarn and a second yarn.

The first yarn was a 14-cotton count sheath-core yarn having a para-aramid fiber sheath and a 50 micron stainless steel wire core, spun on a ring spinning frame. The para-aramid fiber was 2-inch poly(paraphenylene terephthalamide) staple.

The second yarn was an 18-cotton count sheath-core yarn made by core-spinning on a ring spinning frame of 2-inch modacrylic staple around a 70-denier spandex core; the spandex core was stretched 3× as it was incorporated(spun) into the sheath-core yarn.

The resulting ply-twisted elastic yarn made by ply twisting the first yarn and the second yarn had a total cotton count of 16/2, or 675 denier. Relative amounts of the yarn components are shown in Table 2.

The resulting ply-twisted elastic yarn was knitted into a 13-gauge sleeve on a Shima-Seiki glove knitting machine. The resulting sleeve had excellent hand and form-fitting properties. A fabric sample from resulting sleeve was flame tested in accordance with fire-resistant glove test method detailed in the NFPA-2112-2018 standard. The resulting stretch fabric was found to have 0-seconds of after-flame with 4.8% of the weight consumed during the tests, which was in below the 2-second maximum after-flame requirement and the 5% weight loss limit allowed in the specification.

TABLE 2

| Component | Weight Percent of Ply-twisted yarn (%) | Weight Percent in Singles Yarn (%) |
|---|---|---|
| Para-aramid Fiber | 36.4 | 65 |
| Steel Wire | 19.8 | 35 |

TABLE 2-continued

| Component | Weight Percent of Ply-twisted yarn (%) | Weight Percent in Singles Yarn (%) |
|---|---|---|
| Modacrylic Fiber | 40.3 | 92 |
| Elastic Fiber | 3.5 | 8 |

Example 2

The ply-twisted elastic yarn of Example 1 was repeated, with the following exceptions. The first yarn was a 26-cotton count yarn having a para-aramid fiber sheath and a stainless steel wire core made with a 35 micron stainless steel wire core. The second yarn was a 32-cotton count yarn having a modacrylic sheath and a 40 denier spandex core that was stretched 3× during spinning.

As in Example 1, the resulting ply-twisted elastic yarn made by ply twisting the first yarn and the second yarn had a total cotton count of 29/2, or 371 denier. Relative amounts of the yarn components are shown in Table 3.

The resulting ply-twisted elastic yarn was knitted into an 18 gauge sleeve on a Shima-Seiki glove knitting machine. The resulting sleeve had excellent form-fitting properties. A fabric sample from resulting sleeve was washed to remove knitting oils and finishes and flame tested in accordance with fire-resistant glove test method detailed in the NFPA-2112-2018 standard. The resulting stretch fabric was found to have 0 seconds of after-flame with 3.3% of the weight consumed during the tests, which was in below the 2-second maximum after-flame requirement and the 5% weight loss limit allowed in the specification.

TABLE 3

| Component | Weight Percent of Ply-twisted yarn (%) | Weight Percent in Singles Yarn (%) |
|---|---|---|
| Para-aramid Fiber | 37.4 | 68 |
| Steel Wire | 17.8 | 32 |
| Modacrylic Fiber | 41.2 | 92 |
| Elastic Fiber | 3.6 | 8 |

Example 3

The ply-twisted elastic yarn of Example 1 was repeated, with the following exceptions.

The first yarn was a 19.5-cotton count yarn having a para-aramid fiber sheath and a stainless steel wire core made with a 45 micron stainless steel wire core. The second yarn was a 32-cotton count sheath-core yarn having a 40-denier spandex core that was stretched 3× during spinning; however, the sheath was a blend of 82 weight % modacrylic staple fiber and 10 weight percent of a 2-inch cut-length meta-aramid staple fiber blend; specifically, the meta-aramid blend contained 93 weight % poly(metaphenylene isophthalamide) staple fiber, 5 weight % poly(paraphenylene terephthalamide) staple, and 2 weight % carbon-core nylon antistatic fiber.

As in Example 1, the resulting ply-twisted elastic yarn made by ply twisting the first yarn and the second yarn had a total cotton count of 24/2, or 439 denier. Relative amounts of the yarn components are shown in Table 4.

The resulting ply-twisted elastic yarn was knitted into an 18-gauge sleeve on a Shima-Seiki glove knitting machine. The resulting sleeve had excellent form-fitting properties.

A fabric sample of the sleeve that was produced was washed to remove knitting oils and finishes and then flame tested in accordance with fire-resistant glove test method detailed in the NFPA-2112-2018 standard. The resulting stretch fabric was found to have 0-seconds of after-flame with 3.9% of the weight consumed during the tests, which was in below the 2-second maximum after-flame requirement and the 5% weight loss limit allowed in the specification.

Another fabric sample of the sleeve that was produced was flame tested in accordance with fire-resistant glove test method detailed in the EN407:2020 standard. The resulting stretch fabric was found to have 0-seconds of after-flame and 0-seconds of after-glow after 3 seconds and 15 seconds of exposure to the flame, which was in below the 2-second maximum after-flame and 5-second maximum after-glow requirement to achieve the highest ranking described in the specification.

TABLE 4

| Component | Weight Percent of Ply-twisted yarn (%) | Weight Percent in Singles Yarn (%) |
|---|---|---|
| Para-Aramid Fiber | 37.3 | 58 |
| Steel Wire | 24.9 | 42 |
| Modacrylic Fiber | 31.0 | 82 |
| Meta-Aramid Fiber* | 3.8 | 10 |
| Elastic Fiber | 3.0 | 8 |

*Actual blend of 93 wt % meta-aramid fiber, 5 wt % para-aramid fiber, and 2 wt % carbon-core nylon antistatic fiber.

Comparative Example A

A comparative ply-twisted elastic yarn similar to that of Example 3 was made; however, the first yarn having a para-aramid fiber sheath and a stainless steel wire core was made with 1.5-inch poly(paraphenylene terephthalamide) staple and a 45-micron stainless steel wire core. The second yarn, which was again a 32-cotton count sheath-core yarn, had a sheath of solely 1.5 inch cut-length nylon staple core-spun around the 40-denier spandex core.

The resulting 24's-2 count ply-twisted yarn was knitted into an 18-gauge sleeve on a Shima-Seiki glove knitting machine. The resulting sleeve had excellent form fitting properties.

However, the sample produced was flame tested in accordance with fire-resistant glove test method detailed in the EN407:2020 standard. The resulting stretch fabric was found to have at least 25-seconds of after-flame after 3 seconds of exposure to the flame, which was higher than 20-second maximum after-flame requirement to achieve even the lowest ranking described in the specification.

Because of the excessive afterflame with only 3-seconds of flame exposure, subsequent testing was not done for 15-second exposure in the EN407 test nor the 12-second exposure in the NFPA-2112 test.

TABLE 5

| Ex. | Yarn Type | Knit Type | First Yarn | Second Yarn | After Flame (sec) | Weight Loss % |
|---|---|---|---|---|---|---|
| 1 | One Ply-Twisted Yarn | 13 Gauge Knit | Para-Aramid Sheath/ Steel Core | Modacrylic Sheath/ Spandex Core | 2 | 4.8 |

TABLE 5-continued

| Ex. | Yarn Type | Knit Type | First Yarn | Second Yarn | After Flame (sec) | Weight Loss % |
|---|---|---|---|---|---|---|
| 2 | One Ply-Twisted Yarn | 18 Gauge Knit | Para-Aramid Sheath/ Steel Core | Modacrylic Sheath/ Spandex Core | 0 | 3.3 |
| 3 | One Ply-Twisted Yarn | 18 Gauge Knit | Para-Aramid Sheath/ Steel Core | Modacrylic + Meta-Aramid Sheath/ Spandex Core | 0 | 3.9 |
| A | One Ply-Twisted Yarn | 18 Gauge Knit | Para-Aramid Sheath/ Steel Core | Nylon Sheath/ Spandex Core | >25 | NA |

The invention claimed is:

1. A ply-twisted yarn suitable for use in a flame-retardant, cut-resistant fabric, the ply-twisted yarn comprising:

(a) at least one first yarn comprising at least 50 weight percent heat-resistant polymeric fiber, wherein at least 30 weight percent of the heat-resistant polymeric fiber present in the at least one first yarn is a cut-resistant heat-resistant polymeric fiber having a cut resistance of 500 grams force or higher per ASTM F2992-15, wherein the at least one first yarn has a sheath/core construction with a sheath comprising the cut-resistant heat-resistant polymeric fiber and a core comprising an inorganic fiber, wherein the heat-resistant polymeric fibers are para-aramid fibers; and (b) at least one second yarn having a sheath/core construction with a sheath of halogenated self-extinguishing staple fibers and a core comprising at least one continuous elastomeric filament, wherein 60 to 95 weight percent of the at least one second yarn is halogenated self-extinguishing fiber, and the halogenated self-extinguishing fiber is in contact with the at least one continuous elastomeric filament, the at least one second yarn being free or substantially free of inorganic fibers;

wherein the sheath of the at least one second yarn consists of halogenated self-extinguishing staple fibers; wherein the halogenated self-extinguishing staple fibers are made from a modacrylic polymer having less than 1.5 weight percent antimony oxide or antimony oxides, wherein at least 90% of the core is covered by the sheath.

2. The ply-twisted yarn of claim 1, wherein the para-aramid fiber is poly(paraphenylene terephthalamide).

3. The ply-twisted yarn of claim 1, wherein the at least one first yarn further comprises a flame resistant fiber that is not cut-resistant.

4. The ply-twisted yarn of claim 3, wherein the flame resistant fiber is meta-aramid, polyamide-imide, flame-retardant-treated (FR) cellulose, FR cotton, FR lyocell, or mixtures thereof.

5. The ply-twisted yarn of claim 4, wherein the flame resistant fiber is meta-aramid.

6. The ply-twisted yarn of claim 5, wherein the meta-aramid is poly(metaphenylene isophthalamide).

7. The ply-twisted yarn of claim 1, wherein 5 to 40 weight percent of the total weight of the at least one second yarn is the at least one continuous elastomeric filament.

8. The ply-twisted yarn of claim 1, wherein the at least one continuous elastomeric filament is a spandex filament.

9. The ply-twisted yarn of claim 1, wherein the inorganic fiber is a metal filament.

10. A woven or knit fabric comprising the ply-twisted yarn of claim 1.

11. The woven or knit fabric comprising the ply-twisted yarn of claim 10 wherein the fabric has a maximum after-flame time of two seconds or less and weight loss of 5 weight percent or less when tested per NFPA-2112-2018.

12. An article comprising the woven or knit fabric of claim 11.

13. The article of claim 12 in the form of a glove, sleeve, or apron.

* * * * *